US009076576B2

(12) United States Patent
Saito et al.

(10) Patent No.: US 9,076,576 B2
(45) Date of Patent: Jul. 7, 2015

(54) CHIP THERMISTOR AND THERMISTOR ASSEMBLY BOARD

(75) Inventors: Yo Saito, Tokyo (JP); Kouki Yamada, Tokyo (JP); Yukihiro Murakami, Tokyo (JP)

(73) Assignee: TDK CORPORATION, Tokyo (JP)

( * ) Notice: Subject to any disclaimer, the term of this patent is extended or adjusted under 35 U.S.C. 154(b) by 162 days.

(21) Appl. No.: 13/884,390

(22) PCT Filed: Oct. 18, 2011

(86) PCT No.: PCT/JP2011/073962

§ 371 (c)(1), (2), (4) Date: May 9, 2013

(87) PCT Pub. No.: WO2012/070336

PCT Pub. Date: May 31, 2012

(65) Prior Publication Data

US 2013/0222106 A1 Aug. 29, 2013

(30) Foreign Application Priority Data

Nov. 22, 2010 (JP) ..... 2010-260187

(51) Int. Cl.

| | |
|---|---|
| ***H01C 7/10*** | (2006.01) |
| ***H01C 7/00*** | (2006.01) |
| ***H01C 7/02*** | (2006.01) |
| ***H01C 7/04*** | (2006.01) |

(52) U.S. Cl.

CPC ..... *H01C 7/008* (2013.01); *H01C 7/021* (2013.01); *H01C 7/041* (2013.01)

(58) Field of Classification Search

CPC ..... H01C 7/021; H01C 7/041; H01C 7/008

USPC ..... 338/22 R, 195

See application file for complete search history.

(56) References Cited

U.S. PATENT DOCUMENTS

| | | | | |
|---|---|---|---|---|
| 4,031,499 | A * | 6/1977 | Brueckner | 338/23 |
| 4,151,401 | A * | 4/1979 | Van Bokestal et al. | 219/508 |
| 4,200,970 | A * | 5/1980 | Schonberger | 29/593 |

(Continued)

FOREIGN PATENT DOCUMENTS

| | | | |
|---|---|---|---|
| JP | S55-156301 | A | 12/1980 |
| JP | S61-072834 | U | 5/1986 |

(Continued)

OTHER PUBLICATIONS

International Preliminary Report on Patentability issued in Application No. PCT/JP2011/073962; Dated Jun. 12, 2013.

(Continued)

*Primary Examiner* — Kyung Lee
(74) *Attorney, Agent, or Firm* — Oliff PLC

(57) ABSTRACT

A chip thermistor is provided with a thermistor element body, a first electrode, a second electrode, and a third electrode. The thermistor element body has a first principal face and a second principal face opposed to each other in a first direction. The first electrode and the second electrode are arranged as separated from each other in a second direction perpendicular to the first direction, on the first principal face of the thermistor element body. The third electrode is arranged so as to lap over the first electrode and the second electrode, when viewed from the first direction, on the second principal face of the thermistor element body.

4 Claims, 18 Drawing Sheets

(56) References Cited

U.S. PATENT DOCUMENTS

| | | | | |
|---|---|---|---|---|
| 4,434,416 | A * | 2/1984 | Schonberger | 338/22 R |
| 5,537,286 | A * | 7/1996 | Gozlan et al. | 361/106 |

FOREIGN PATENT DOCUMENTS

| | | |
|---|---|---|
| JP | A-62-033401 | 2/1987 |
| JP | S63-070102 U | 5/1988 |
| JP | A-63-216301 | 9/1988 |
| JP | A-02-226701 | 9/1990 |
| JP | A-05-013205 | 1/1993 |
| JP | A-09-115706 | 5/1997 |
| JP | A-2001-167907 | 6/2001 |
| JP | A-2004-288968 | 10/2004 |

OTHER PUBLICATIONS

International Search Report issued in Application No. PCT/JP2011/073962; Dated Jan. 17, 2012 (With Translation).

Dec. 2, 2014 Office Action issued in Japanese Application No. 2012-545656.

* cited by examiner

CHIP THERMISTOR AND THERMISTOR ASSEMBLY BOARD

TECHNICAL FIELD

The present invention relates to a chip thermistor and a thermistor assembly board.

BACKGROUND ART

There is a known chip thermistor provided with a thermistor element body having a pair of principal faces opposed to each other, and a pair of electrodes arranged as separated from each other on one principal face of the thermistor element body (e.g., cf. Patent Literature 1).

CITATION LIST

Patent Literature

Patent Literature 1: Japanese Patent Application Laid-open No. S62-33401

SUMMARY OF INVENTION

Technical Problem

In the chip thermistor described in Patent Literature 1, the whole of the thermistor element body does not contribute to the characteristics thereof, but a partial region between the pair of electrodes in the thermistor element body and near the principal face where the pair of electrodes are arranged mainly contributes to the characteristics. The depth of the partial region contributing to the characteristics (the distance from the principal face where the pair of electrodes are arranged) is likely to disperse. This dispersion affects the resistance and it was difficult to obtain a high-accuracy chip thermistor with stable characteristics. In the chip thermistor described in Patent Literature 1, the dimensional accuracy between the pair of electrodes is also likely to disperse. This dispersion may also affect the resistance.

It is an object of the present invention to provide a high-accuracy chip thermistor with small dispersion of resistance. It is another object of the present invention to provide a thermistor assembly board for obtaining high-accuracy chip thermistors with small dispersion of resistance.

Solution to Problem

A chip thermistor according to the present invention is one comprising: a thermistor element body having first and second principal faces opposed to each other in a first direction; first and second electrodes arranged as separated from each other in a second direction perpendicular to the first direction, on the first principal face of the thermistor element body; and a third electrode arranged so as to lap over the first and second electrodes, when viewed from the first direction, on the second principal face of the thermistor element body.

In the chip thermistor according to the present invention, a region between the first electrode and the third electrode (which will be referred to hereinafter as "first region") and a region between the second electrode and the third electrode (which will be referred to hereinafter as "second region") in the thermistor element body are electrically connected in series through the third electrode between the first electrode and the second electrode. For this reason, a resistance component of the chip thermistor is represented by a combined resistance component of parallel connection of a combined resistance component of the first region and the second region connected in series, and a resistance component of a region between the first electrode and the second electrode and near the first principal face in the thermistor element body (which will be referred to hereinafter as "third region"). Since the resistance component of the third region is extremely larger than the resistance component of the first region and the resistance component of the second region because the third region is an extremely thin region of the thermistor element body. For this reason, an electric current flowing in the chip thermistor is more likely to flow in the first region and the second region and less likely to flow in the third region. Therefore, the characteristics of the chip thermistor are dominantly determined by the first region and the second region and these regions mainly contribute to the characteristics.

The value of the resistance component of the first region is proportional to a spacing between the first electrode and the third electrode and inversely proportional to an overlapping area between the first electrode and the third electrode. Since the spacing between the first electrode and the third electrode is controlled by the thickness of the thermistor element body, it is unlikely to disperse. Since the overlapping area between the first electrode and the third electrode is a relatively large value, even if it has some dispersion, influence thereof will be little. Therefore, the value of the resistance component of the first region is unlikely to disperse. Similarly, the value of the resistance component of the second region is unlikely to disperse. As a result of these, the chip thermistor of the present invention has small dispersion of resistance and demonstrates high accuracy.

A creepage distance between the first electrode and the second electrode in the second direction may be set to be larger than a clearance between the first electrode and the second electrode in the second direction. In this case, the value of the resistance component of the third region becomes much larger. For this reason, the characteristics of the chip thermistor are more dominantly determined by the first region and the second region, whereby the dispersion of resistance can be kept extremely small.

Unevenness may be formed in a region between the first electrode and the second electrode on the first principal face. In this case, we can surely obtain the configuration wherein the creepage distance between the first electrode and the second electrode in the second direction is set to be larger than the clearance between the first electrode and the second electrode in the second direction.

A groove extending in a direction intersecting with the second direction may be formed in the region between the first electrode and the second electrode on the first principal face. In this case, we can appropriately and readily obtain the configuration wherein the creepage distance between the first electrode and the second electrode in the second direction is set to be larger than the clearance between the first electrode and the second electrode in the second direction. For example, the value of the resistance component of the third region can be readily controlled to a desired value, by the depth and number of grooves to be formed.

When viewed from the first direction, the first principal face may be located inside an outer contour line of the second principal face and the first and second electrodes may be located inside an outer contour line of the third electrode. There will be no change in an overlapping area between the first electrode and the third electrode and in an overlapping area between the second electrode and the third electrode even if there is a positional deviation of the first and second electrodes. Therefore, the positional deviation will not induce dispersion of the characteristics.

A thermistor assembly board according to the present invention is one comprising: a thermistor substrate having first and second principal faces opposed to each other in a first direction; a plurality of electrode pairs arranged on the first principal face of the thermistor substrate, each electrode pair consisting of first and second electrodes separated from each other in a second direction perpendicular to the first direction; and an electrode arranged so as to lap over the plurality of electrode pairs, when viewed from the first direction, on the second principal face of the thermistor substrate.

In the thermistor assembly board according to the present invention, a portion corresponding to each electrode pair functions as a chip thermistor. Therefore, we can obtain the thermistor assembly board for obtaining the high-accuracy chip thermistors with small dispersion of resistance, as described above.

In the thermistor substrate, grooves may be formed from the first principal face side so as to mark off each of the plurality of electrode pairs.

A creepage distance between the first electrode and the second electrode in the second direction may be set to be larger than a clearance between the first electrode and the second electrode in the second direction. In this case, the value of the resistance component of the region between the first electrode and the second electrode and near the first principal face in the thermistor substrate becomes much larger. Therefore, we can obtain the thermistor assembly board for obtaining the high-accuracy chip thermistors with extremely small dispersion of resistance.

Unevenness may be formed in a region between the first electrode and the second electrode on the first principal face. In this case, we can surely obtain the configuration wherein the creepage distance between the first electrode and the second electrode in the second direction is set to be larger than the clearance between the first electrode and the second electrode in the second direction.

A groove extending in a direction intersecting with the second direction may be formed in the region between the first electrode and the second electrode on the first principal face. In this case, we can appropriately and easily obtain the configuration wherein the creepage distance between the first electrode and the second electrode in the second direction is set to be larger than the clearance between the first electrode and the second electrode in the second direction.

Advantageous Effects of Invention

The present invention can provide the high-accuracy chip thermistor with small dispersion of resistance. Furthermore, the present invention can provide the thermistor assembly board for obtaining the high-accuracy chip thermistors with small dispersion of resistance.

DESCRIPTION OF EMBODIMENTS

The preferred embodiments of the present invention will be described below in detail with reference to the accompanying drawings. In the description, the same elements or elements with the same functionality will be denoted by the same reference signs, without redundant description.

Figure 1:
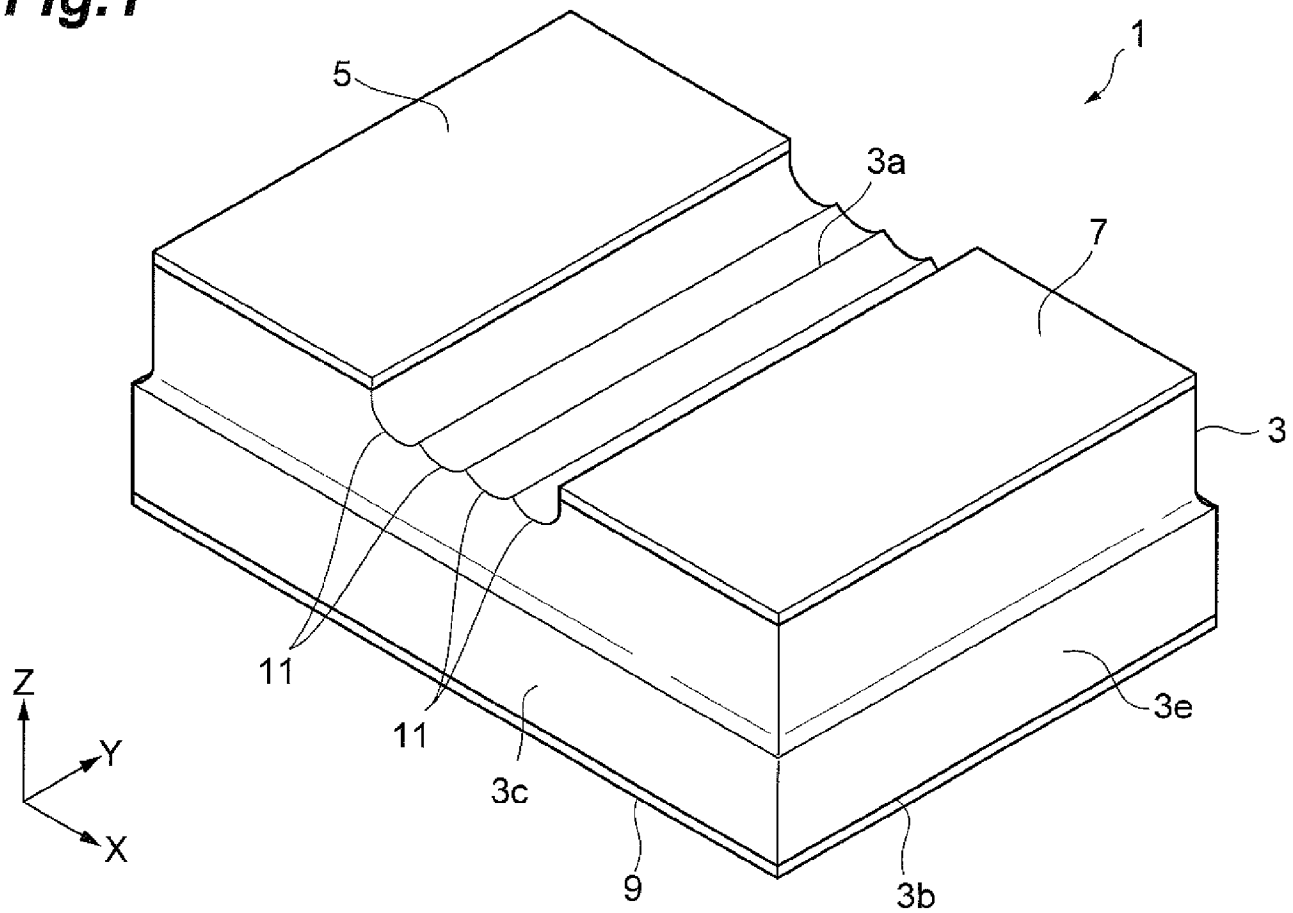
FIG. 1 is a perspective view showing a chip thermistor according to an embodiment of the present invention.
Figure 2:
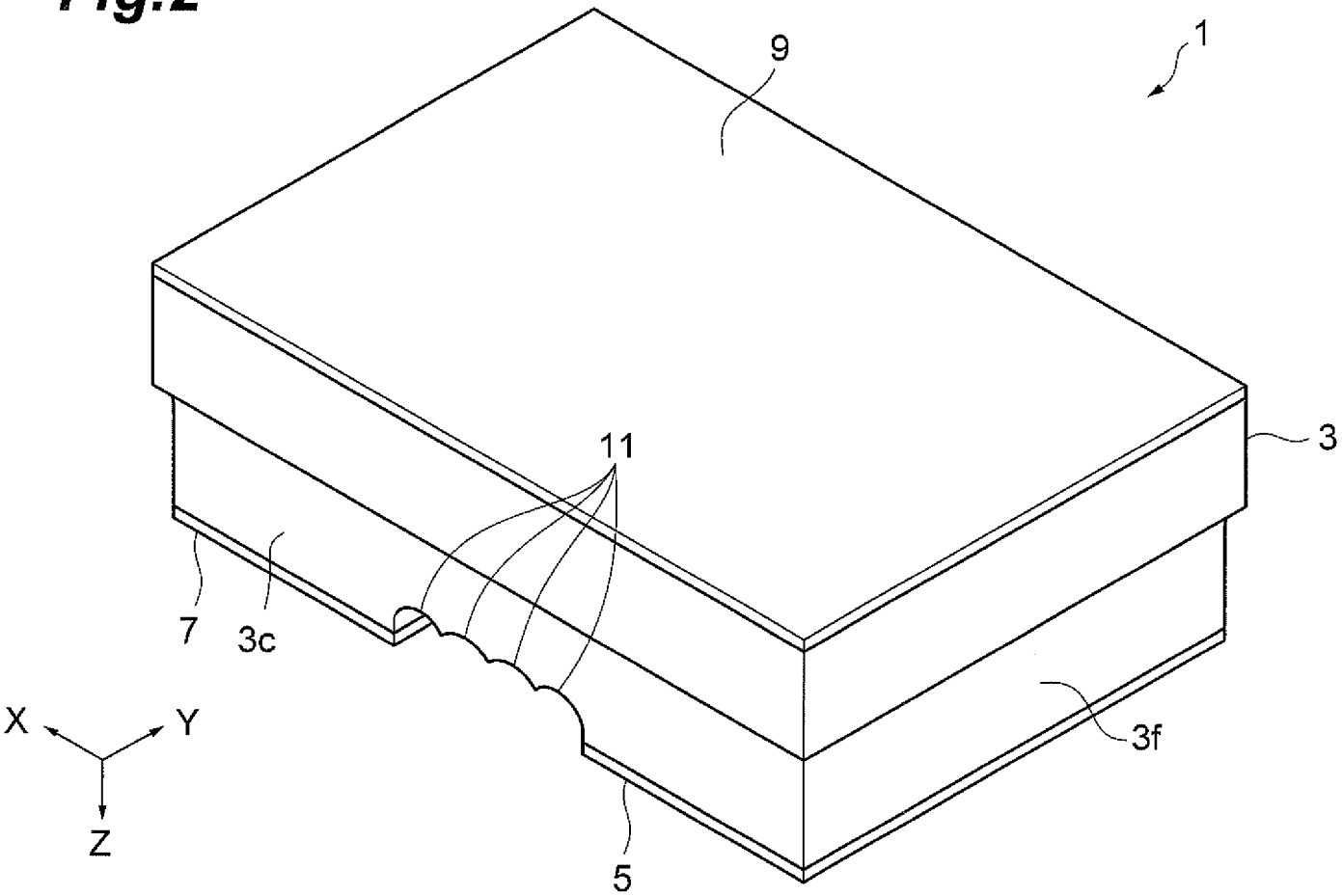
FIG. 2 is a perspective view showing the chip thermistor according to the embodiment.
Figure 3:
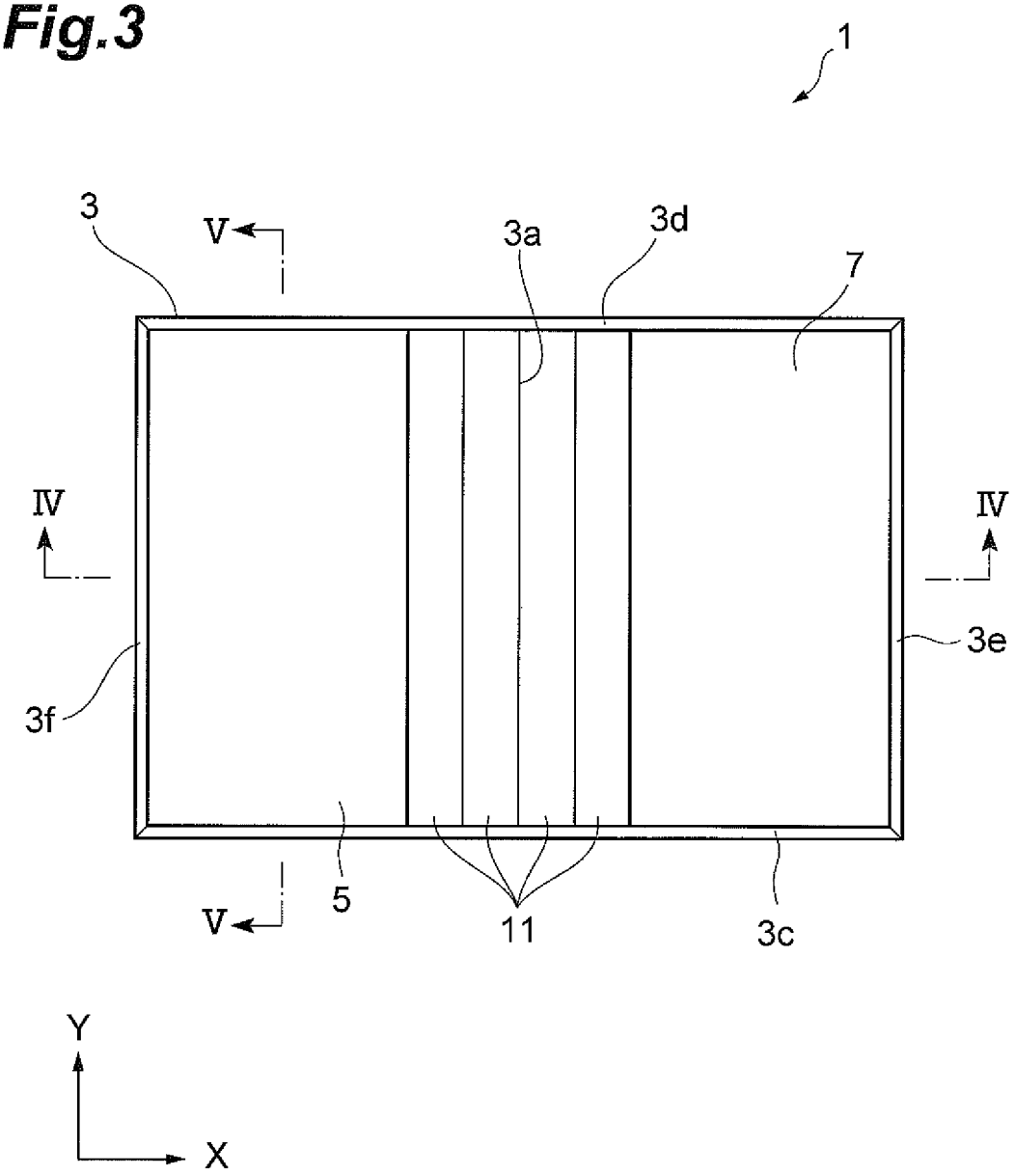
FIG. 3 is a plan view showing the chip thermistor according to the embodiment.
Figure 4:
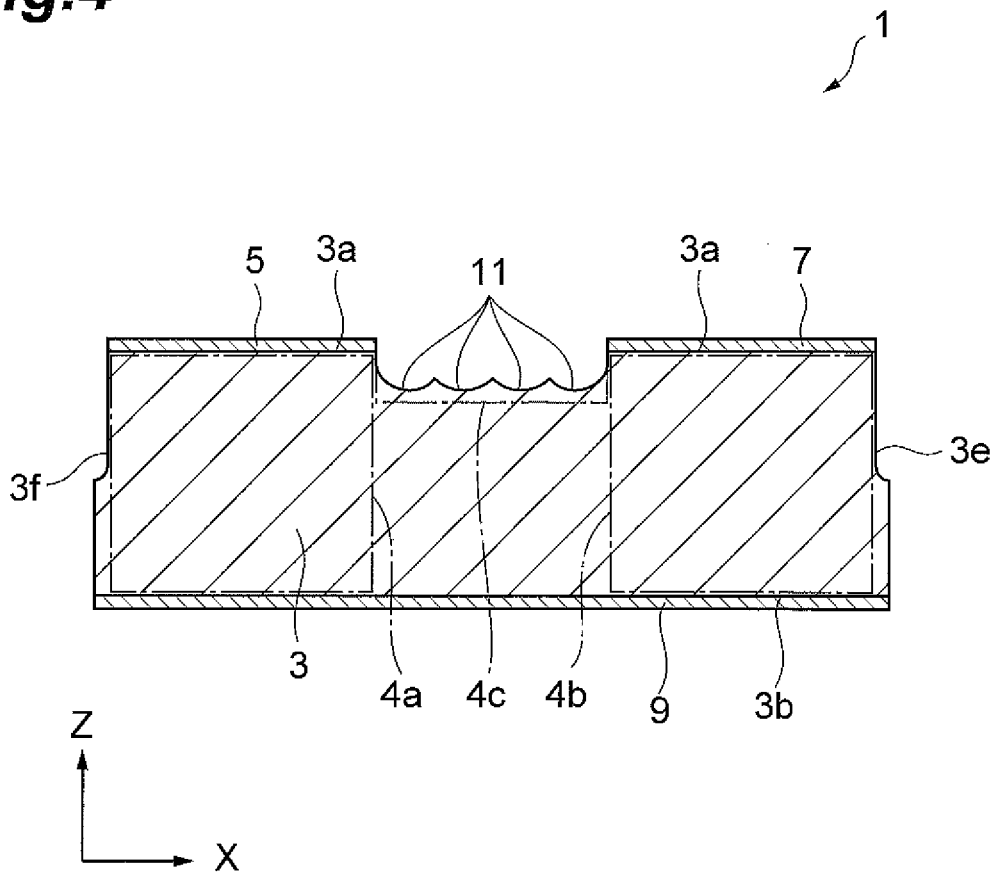
FIG. 4 is a drawing for explaining a cross-sectional configuration along the line IV-IV shown in FIG. 3.
Figure 5:
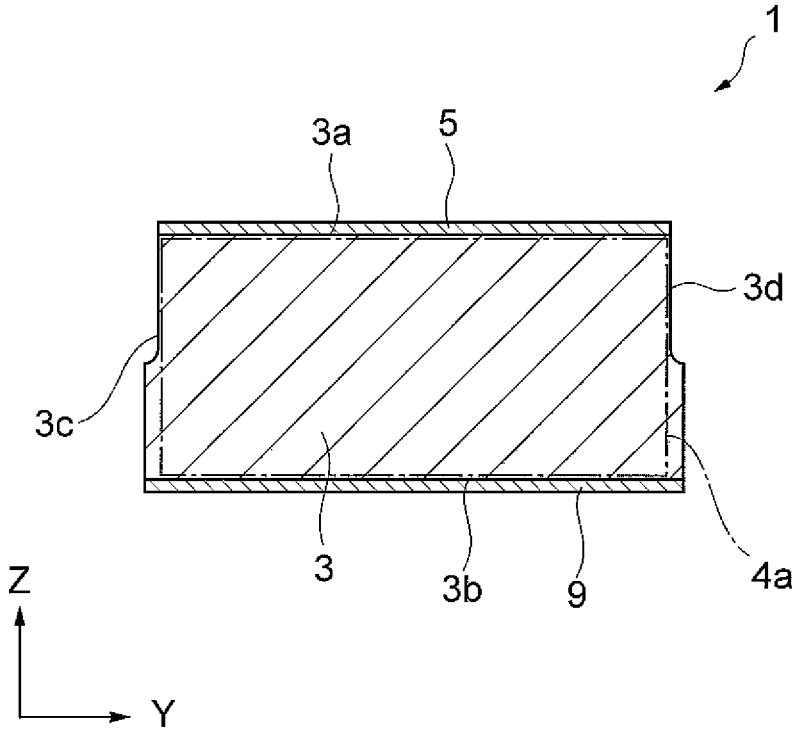
FIG. 5 is a drawing for explaining a cross-sectional configuration along the line V-V shown in FIG. 3.

First, a configuration of a chip thermistor 1 according to an embodiment of the present invention will be described with reference to FIGS. 1 to 5. FIGS. 1 and 2 are perspective views showing the chip thermistor according to the present embodiment. FIG. 3 is a plan view showing the chip thermistor according to the present embodiment. FIG. 4 is a drawing for explaining a cross-sectional configuration along the line IV-IV shown in FIG. 3. FIG. 5 is a drawing for explaining a cross-sectional configuration along the line V-V shown in FIG. 3.

The chip thermistor 1, as shown in FIGS. 1 to 5, is provided with a thermistor element body 3, a first electrode 5, a second electrode 7, and a third electrode 9. The chip thermistor 1 is an NTC (Negative Temperature Coefficient) thermistor. The chip thermistor 1 has a nearly rectangular parallelepiped shape. The chip thermistor 1 is set, for example, in the length of about 0.6 mm, the width of about 0.4 mm, and the height of about 0.2 mm.

The thermistor element body 3 has first and second principal faces 3*a*, 3*b* and four side faces 3*c*-3*f*. The first and second principal faces 3*a*, 3*b* are opposed to each other in a first direction (Z-direction in the drawings). The four side faces 3*c*-3*f* extend along the first direction so as to connect the first principal face 3*a* and the second principal face 3*b*. The thermistor element body 3 is made, for example, of a spinel-type metal oxide containing Mn as a major component and further containing at least one or more of Ni, Co, Ca, Zr, Al, Cu, and Fe as minor component. The thermistor element body 3 is a semiconductor ceramic comprised of the spinel-type metal oxide.

In the thermistor element body 3, the area of the first principal face 3*a* is smaller than that of the second principal face 3*b*. The first principal face 3*a*, when viewed from the first direction, is located inside an outer contour line of the second principal face 3*b*. Therefore, a level difference is formed between the region on the first principal face 3*a* side and the region on the second principal face 3*b* side in the side faces 3*c*-3*f* of the thermistor element body 3. The thickness of the thermistor element body 3 is set, for example, to about 0.2 mm.

The first electrode 5 and the second electrode 7 are arranged on the first principal face 3*a* of the thermistor element body 3. The first electrode 5 and the second electrode 7 are located as separated from each other in a second direction (e.g., X-direction in the drawings) perpendicular to the first direction. The first and second electrodes 5, 7 have a rectangular shape (oblong shape in the present embodiment). The first electrode 5 and the second electrode 7 are juxtaposed so that long-side directions of the respective electrodes 5, 7 are parallel to each other. The first and second electrodes 5, 7 are set, for example, in the size of about 0.4 mm×0.2 mm. The clearance between the first electrode 5 and the second electrode 7 in the second direction is set, for example, to about 0.2 mm.

The third electrode 9 is arranged on the second principal face 3*b* of the thermistor element body 3. The third electrode 9 is located so as to lap over the first and second electrodes 5, 7 when viewed from the first direction. The third electrode 9 has a rectangular shape (oblong shape in the present embodiment). In the present embodiment, the third electrode 9 is formed so as to cover the whole of the second principal face 3*b*. The first and second electrodes 5, 7 are set, for example, in the size of about 0.6 mm×0.4 mm.

Figure 6:
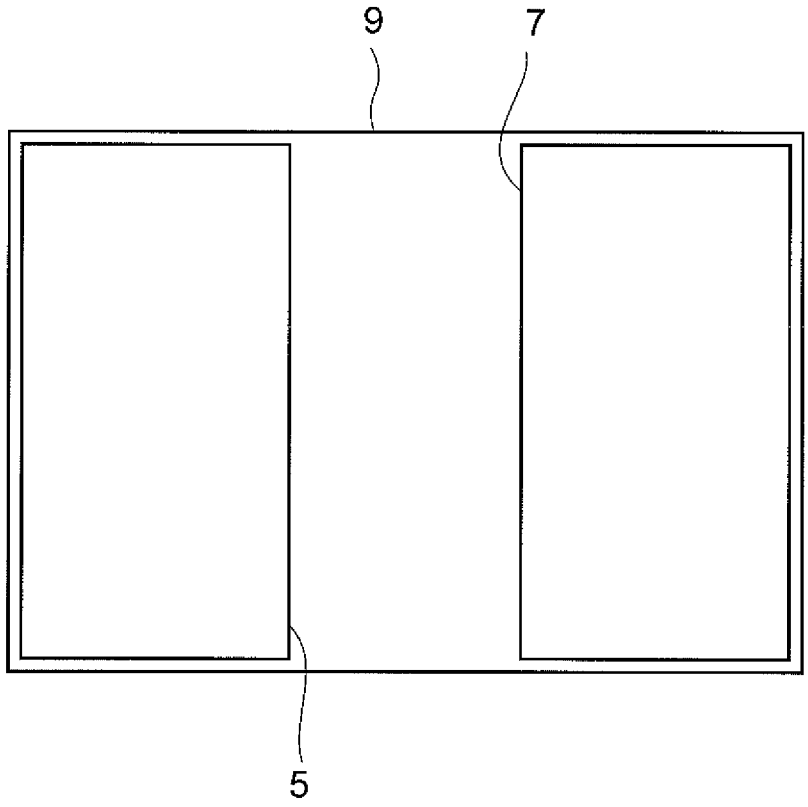
FIG. 6 is a drawing for explaining the positional relationship among the first to third electrodes.

The first and second electrodes 5, 7, as shown in FIG. 6, are located inside an outer contour line of the third electrode 9 when viewed from the first direction. Therefore, the whole of first electrode 5 is opposed to the third electrode 9 in the first direction and the whole of second electrode 7 is opposed to the third electrode 9 in the first direction. FIG. 6 is a drawing for explaining the positional relationship among the first to third electrodes, when viewed from the first direction.

The first to third electrodes 5, 7, 9 are comprised of an electroconductive material (e.g., Ag or the like) that is usually used as electrodes of chip type electronic components. The first to third electrodes 5, 7, 9 are constructed as sintered bodies of an electroconductive paste containing the foregoing electroconductive material. The first to third electrodes 5, 7, 9 may contain a plated layer as an outermost layer. The electroconductive material may contain Au, Pt, Pd, or Cu, instead of aforementioned Ag.

A plurality of (four in the present embodiment) grooves 11 extending in a direction (Y-direction in the drawings) intersecting with (e.g., perpendicular to) the second direction are formed in the region between the first electrode 5 and the second electrode 7 on the first principal face 3*a* of the thermistor element body 3. The plurality of grooves 11 are formed as arranged in a direction perpendicular to the extending direction of the grooves 11. For this reason, unevenness is formed in the region between the first electrode 5 and the second electrode 7 on the first principal face 3*a*, when viewed in the second direction. Since the unevenness is formed, the creepage distance between the first electrode 5 and the second electrode 7 in the second direction is set to be larger than the clearance between the first electrode 5 and the second electrode 7 in the second direction. The extending direction of the grooves 11 is parallel to the long-side directions of the respective electrodes 5, 7. In the present embodiment, the width of the grooves 11 is set to about 50 μm and the depth thereof to about 30 μm.

In the chip thermistor 1, the first principal face 3*a* is a mount surface to be opposed to another component (e.g., a circuit board, an electronic component, or the like). Namely, the chip thermistor 1 is mounted on another component in such a manner that the first and second electrodes 5, 7 are connected to land electrodes of the other component.

The below will describe an example of a manufacturing process of the chip thermistor 1 having the above-described configuration, with reference to FIGS. 7 to 10. FIGS. 7 to 10 are drawings for explaining the manufacturing process of the chip thermistor according to the present embodiment.

Figure 7:
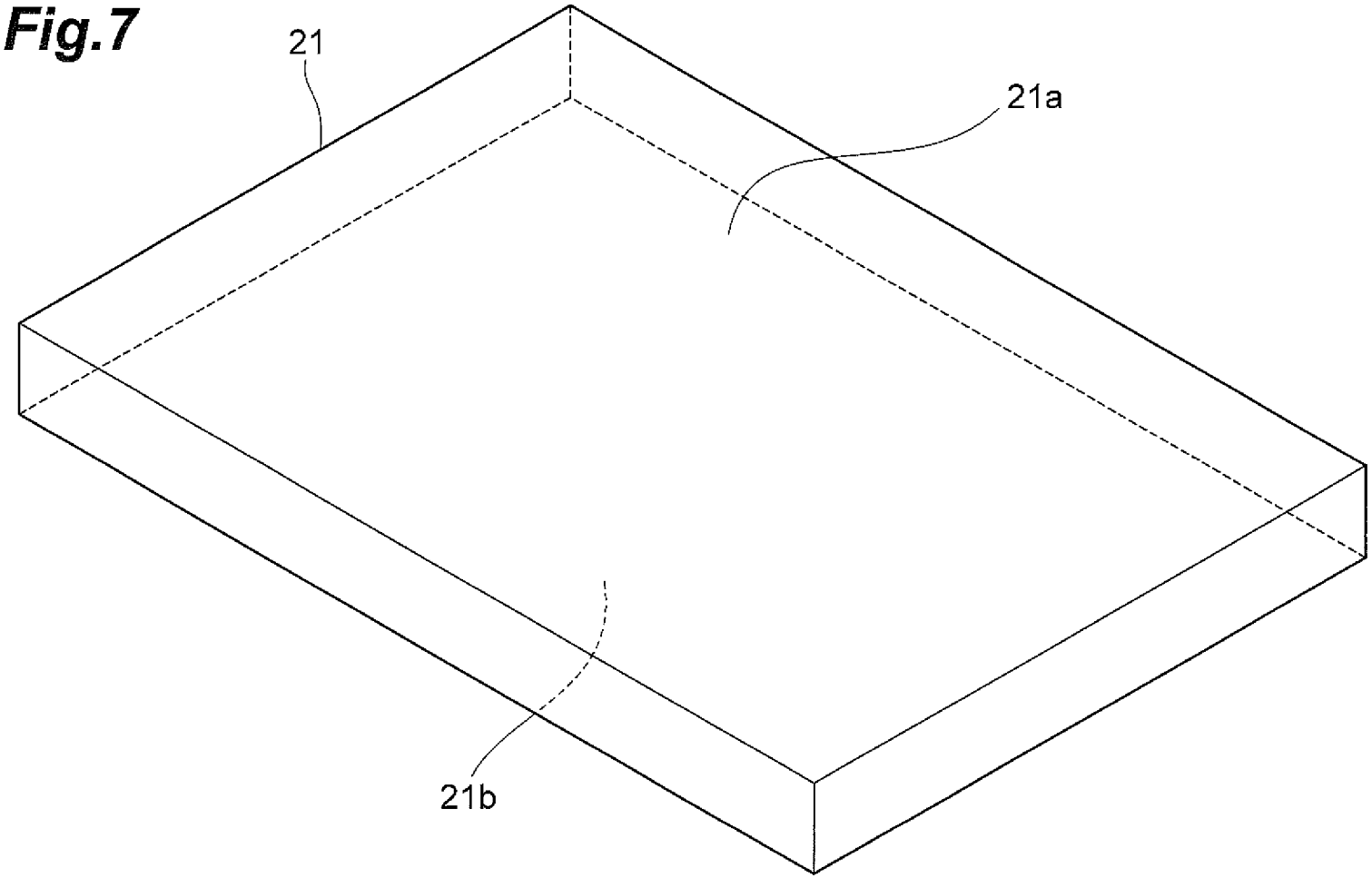
FIG. 7 is a drawing for explaining a manufacturing process of the chip thermistor according to the embodiment.

First, a thermistor substrate 21 is prepared, as shown in FIG. 7. The thermistor substrate 21 has a first principal face 21*a* and a second principal face 21*b* opposed to each other in the first direction (Z-direction in the drawings). The thermistor substrate 21 is formed, for example, by the following process. A metal oxide of Mn as the major component of the thermistor element body 3 and a metal oxide of the minor component (at least one or more of Ni, Co, Ca, Zr, Al, Cu, and Fe) are mixed at a predetermined ratio by a known method to prepare a thermistor material. An organic binder and other materials are then added in this thermistor material to obtain a slurry. Green sheets are formed of the prepared slurry and the formed green sheets are fired. This process results in obtaining the thermistor substrate 21.

Figure 8:
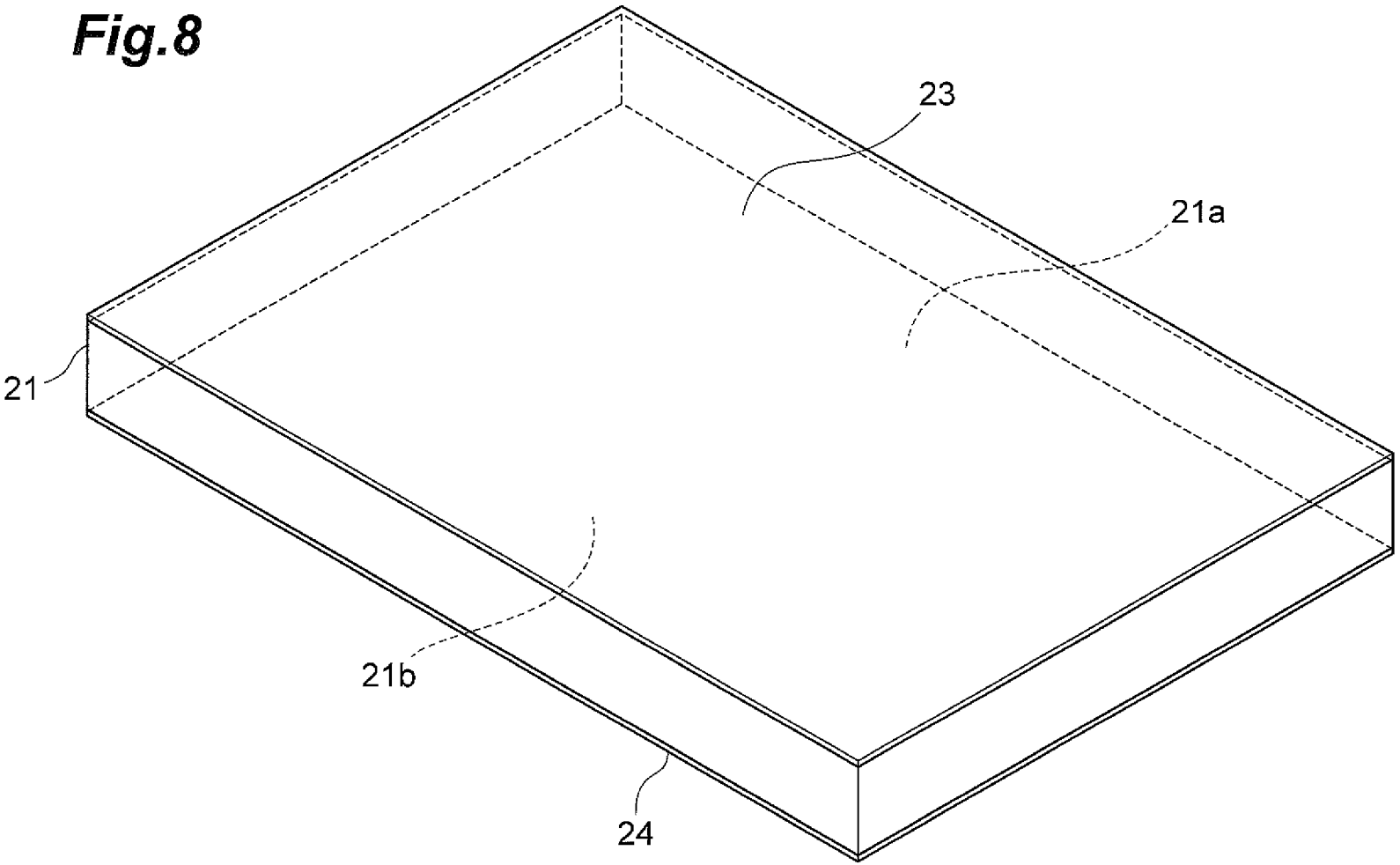
FIG. 8 is a drawing for explaining the manufacturing process of the chip thermistor according to the embodiment.

Next, as shown in FIG. 8, electrodes 23, 24 are formed on the first and second principal faces 21*a*, 21*b*, respectively, of the thermistor substrate 21. The electrodes 23, 24 are formed, for example, by the following process. An electroconductive paste is applied onto each of the principal faces 21*a*, 21*b* of the thermistor substrate 21 by a known method such as screen printing. Then the thermistor substrate 21 with the electroconductive paste applied thereon is subjected to a desired thermal treatment to sinter the electroconductive paste on the thermistor substrate 21. This process results in obtaining the thermistor substrate 21 with the electrodes 23, 24 formed on the first and second principal faces 21*a*, 21*b*, respectively. The electrodes 23, 24 may be formed, for example, by sputtering or the like.

Figure 9:
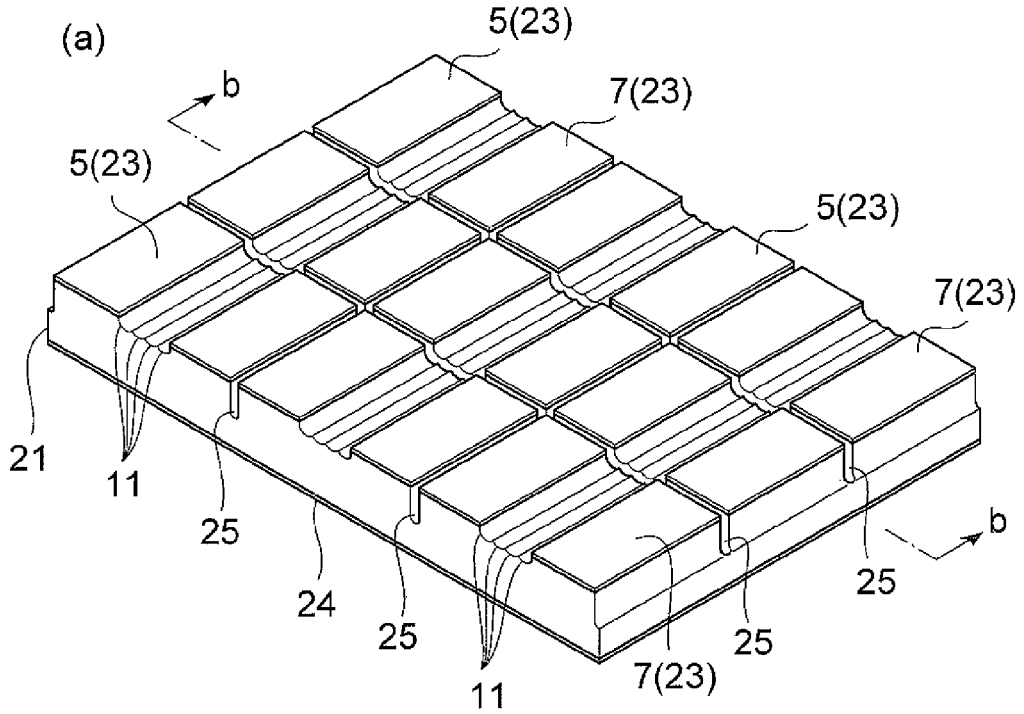
FIG. 9 is a drawing for explaining the manufacturing process of the chip thermistor according to the embodiment.
Figure 9:
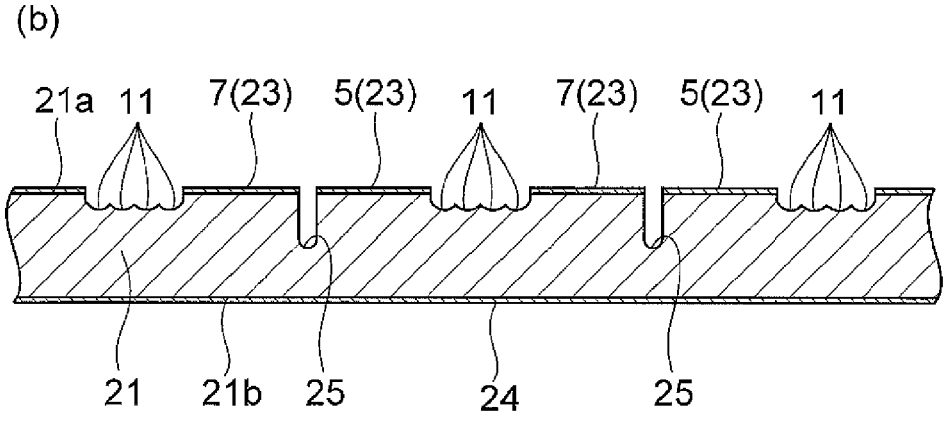

Next, as shown in FIG. 9, grooves 11, 25 are formed in the thermistor substrate 21 from the first principal face 21*a* side. The grooves 11, 25 can be formed, for example, by half cutting the thermistor substrate 21 with a dicing blade. In the present embodiment, the grooves 11, 25 are formed using the same dicing blade. In FIG. 9, (a) is a perspective view showing the thermistor substrate and (b) a drawing for explaining a cross-sectional configuration along the line b-b shown in (a).

The grooves 25 extend in two directions (X-direction and Y-direction in the drawings) perpendicular to the first direction and perpendicular to each other, and are formed in a grid pattern. The depth of the grooves 25 is larger than that of the grooves 11. The grooves 11 are formed so as to extend in the Y-direction, between the grooves 25 extending in the Y-direction. In the present embodiment, the width of the grooves 25 is set to about 50 μm and the depth thereof to about 100 μm.

The grooves 11, 25 are formed in the thermistor substrate 21, i.e., the electrode 23 is cut in conjunction with formation of the grooves 11, 25, thereby to define the first electrodes 5 and the second electrodes 7. The contours of the first and second electrodes 5, 7 are defined by the grooves 11, 25. Through this process, a plurality of electrode pairs, each consisting of the first electrode 5 and the second electrode 7, are arranged on the first principal face 21*a* of the thermistor substrate 21. The plurality of electrode pairs (first and second electrodes 5, 7) are marked off by the grooves 25. The electrode 24 formed on the second principal face 21*b* of the thermistor substrate 21 is arranged so as to lap over the plurality of electrode pairs (first and second electrodes 5, 7) when viewed from the first direction. The thermistor substrate 21 with the grooves 11, 25 formed therein becomes a thermistor assembly board in which the plurality of electrode pairs (first and second electrodes 5, 7) and the electrode 24 are formed.

Figure 10:
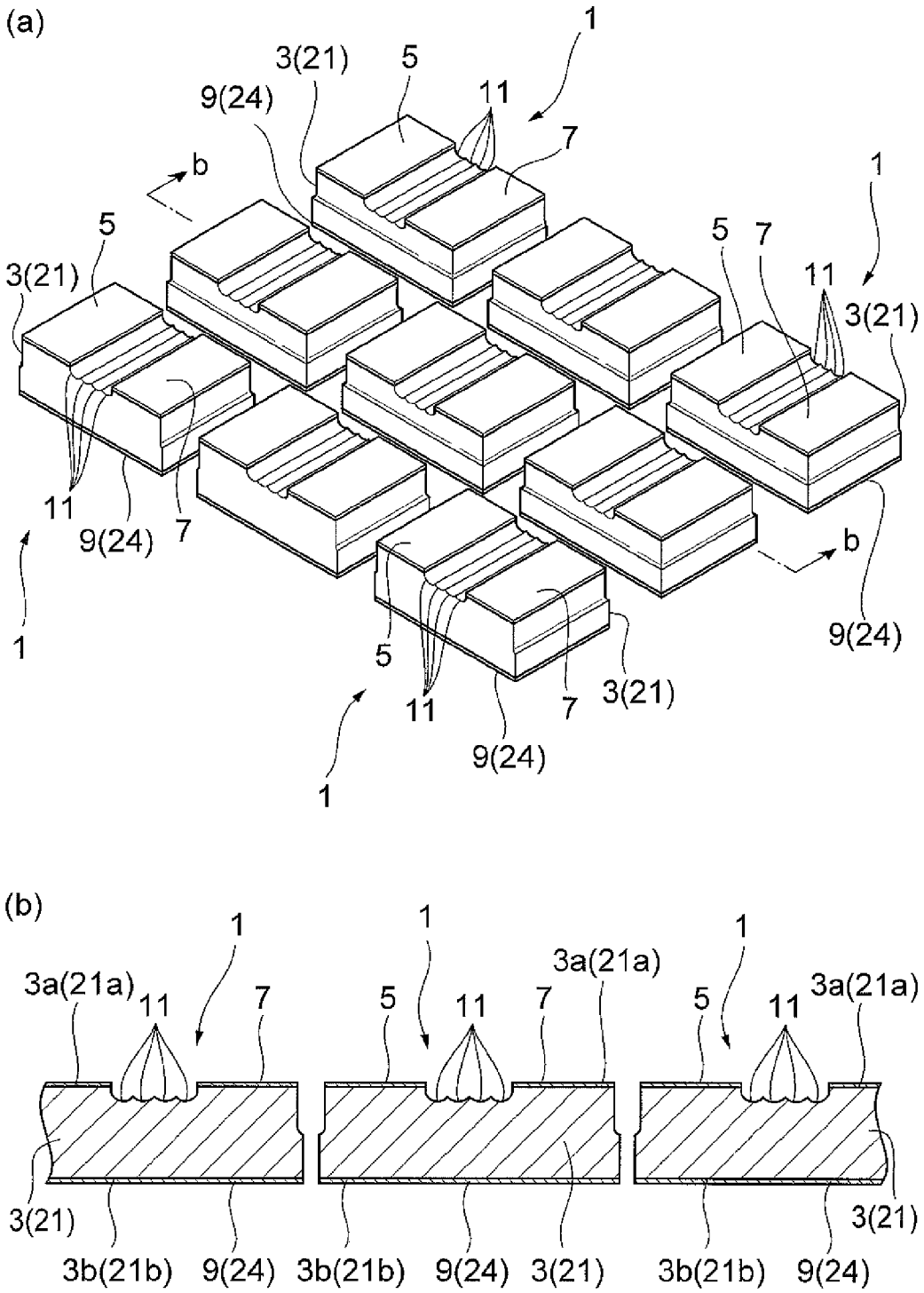
FIG. 10 is a drawing for explaining the manufacturing process of the chip thermistor according to the embodiment.

Next, as shown in FIG. 10, the thermistor substrate 21 is cut at the positions where the grooves 25 are formed, from the first principal face 21*a* side. This process results in obtaining the chip thermistors 1. In FIG. 10, (a) is a perspective view showing the cut thermistor substrate and (b) a drawing for explaining a cross-sectional configuration along the line b-b shown in (a).

The cutting of the thermistor substrate 21 can be performed with a dicing blade in the same manner as the grooves 11, 25 are formed. At this time, the dicing blade used for cutting of the thermistor substrate 21 is one having the width smaller than that of the dicing blade used for formation of the grooves 11, 25. Since the width of the dicing blade used for cutting of the thermistor substrate 21 is smaller than the width of the dicing blade used for formation of the grooves 11, 25, the cutting of the thermistor substrate 21 can be readily carried out.

The third electrodes 9 are defined by the cutting of the thermistor substrate 21, i.e., by cutting of the electrode 24. The contours of the third electrodes 9 are defined by the cutting of the thermistor substrate 21.

In the present embodiment, as described above, a region 4*a* between the first electrode 5 and the third electrode 9 and a region 4*b* between the second electrode 7 and the third electrode 9 in the thermistor element body 3 are electrically connected in series through the third electrode 9 between the first electrode 5 and the second electrode 7 (cf. FIGS. 4 and 5). For this reason, the resistance component of the chip thermistor 1 is represented by a combined resistance component of parallel connection of a combined resistance component of the region 4*a* and the region 4*b* in series connection, and a resistance component of a region 4*c* between the first electrode 5 and the second electrode 7 and near the first principal face 3*a* in the thermistor element body 3. The resistance component of the region 4*c* is extremely larger than the resistance component of the region 4*a* and the resistance component of the region 4*b* because the region 4*c* is an extremely thin region of the thermistor element body 3. For this reason, an electric current flowing in the chip thermistor 1 is more likely to flow in the region 4*a* and the region 4*b* and less likely to flow in the region 4*c*. Therefore, the characteristics of the chip thermistor 1 are dominantly determined by the region 4*a* and the region 4*b* and these regions 4*a*, 4*b* mainly contribute to the characteristics.

In general, the resistance "R" of a chip thermistor with a plurality of opposed electrodes is obtained by the following relational expression.

$$R=(a*\rho*t)/S$$

In this expression, "a" is a coefficient, "ρ" the resistivity of the thermistor material, "t" a distance between the electrodes, and "S" an overlapping area of the electrodes.

Therefore, the value of the resistance component of the region 4*a* is proportional to a spacing between the first electrode 5 and the third electrode 9 and inversely proportional to an overlapping area between the first electrode 5 and the third electrode 9. Since the spacing between the first electrode 5 and the third electrode 9 is controlled by the thickness of the thermistor element body 3, it is unlikely to disperse. Since the overlapping area between the first electrode 5 and the third electrode 9 is a relatively large value, influence thereof is little even if it has some dispersion. Therefore, the value of the resistance component of the region 4*a* is unlikely to disperse. Similarly, the value of the resistance component of the region 4*b* is also unlikely to disperse. As a result of these, the chip thermistor 1 has small dispersion of resistance and demonstrates high accuracy.

In the present embodiment, the plurality of grooves 11 are formed in the region between the first electrode 5 and the second electrode 7 on the first principal face 3*a*. Since this configuration forms the unevenness in the region between the first electrode 5 and the second electrode 7 on the first principal face 3*a*, the creepage distance between the first electrode 5 and the second electrode 7 in the second direction is set to be larger than the clearance between the first electrode 5 and the second electrode 7 in the second direction. For this reason, the value of the resistance component of the region 4*c* becomes much larger and the characteristics of the chip thermistor 1 are more dominantly determined by the region 4*a* and the region 4*b*. Therefore, the dispersion of resistance of the chip thermistor 1 can be kept extremely small.

The present embodiment, as described above, adopts the configuration in which the unevenness is formed by the grooves 11. This allows us to appropriately and easily obtain the configuration in which the creepage distance between the first electrode 5 and the second electrode 7 in the second direction is set to be larger than the clearance between the first electrode 5 and the second electrode 7 in the second direction. For example, the value of the resistance component of the region 4*c* can be readily controlled to a desired value, by the depth and the number of grooves 11 to be formed.

In the present embodiment, when viewed from the first direction, the first principal face 3*a* is located inside the outer contour line of the second principal face 3*b* and the first and second electrodes 5, 7 are located inside the outer contour line of the third electrode 9. Because of this configuration, there is no variation in the overlapping area between the first electrode 5 and the third electrode 9 and in the overlapping area between the second electrode 7 and the third electrode 9 even if the first and second electrodes 5, 7 have some positional deviation. Therefore, the positional deviation does not lead to dispersion of the characteristics of the chip thermistor 1.

In the present embodiment, the third electrode 9 functions as a heat radiation member. When the thermistor element body 3 generates heat, the generated heat is dissipated through the third electrode 9. For this reason, it becomes feasible to set the rated electric power of the chip thermistor 1 high and to prevent self-heating of the chip thermistor 1 (thermistor element body 3). When the self-heating of the chip thermistor 1 is prevented, the chip thermistor 1 improves its temperature measurement accuracy.

Figure 11:
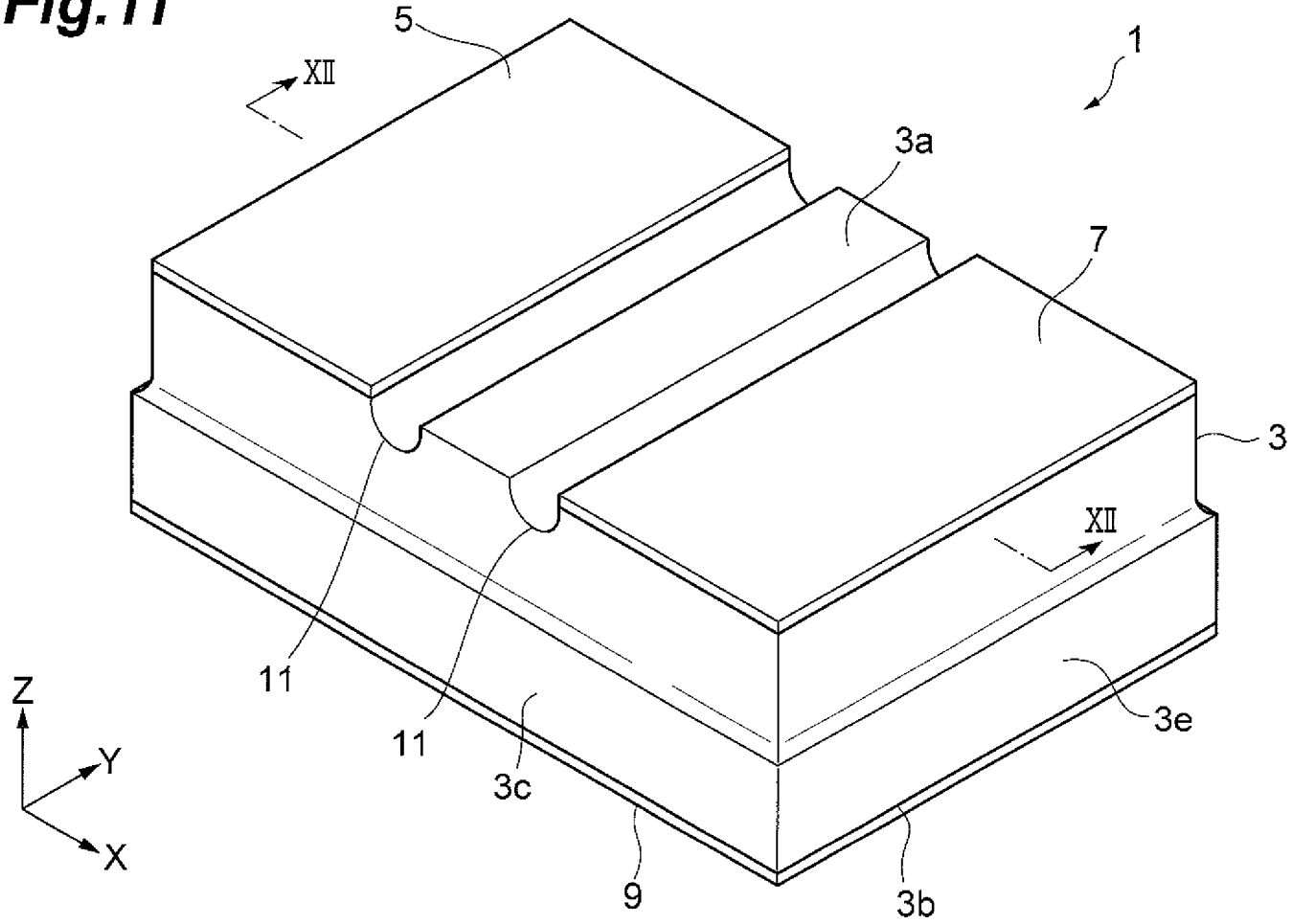
FIG. 11 is a perspective view showing a chip thermistor according to a modification example of the embodiment.
Figure 12:
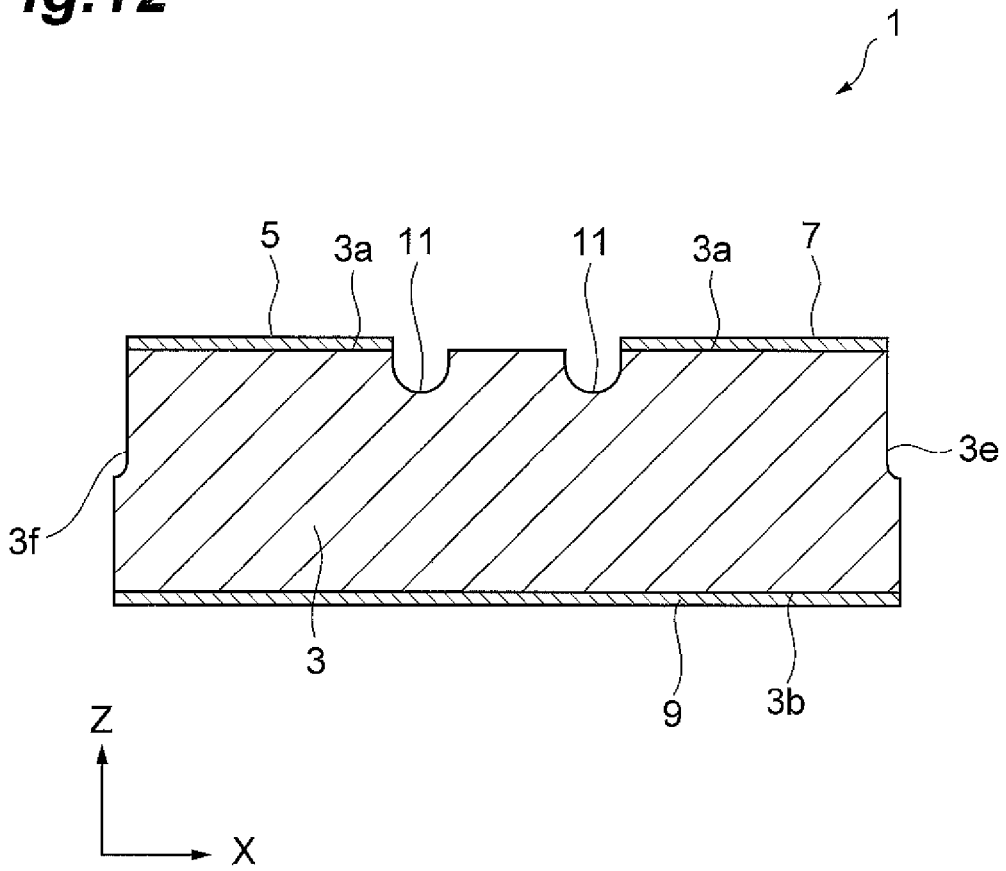
FIG. 12 is a drawing for explaining a cross-sectional configuration along the line XII-XII shown in FIG. 11.

Next, a modification example of the chip thermistor 1 according to the present embodiment will be described with reference to FIGS. 11 and 12. FIG. 11 is a perspective view showing the chip thermistor according to the modification example of the embodiment. FIG. 12 is a drawing for explaining a cross-sectional configuration along the line XII-XII shown in FIG. 11. The present modification example is different in the number of grooves 11 from the aforementioned embodiment.

In the present modification example, the grooves 11 are formed respectively along mutually opposed long sides of the first and second electrodes 5, 7. In the present modification example, the number of grooves 11 is 2. In the present modification example, the creepage distance between the first electrode 5 and the second electrode 7 in the second direction is also set to be larger than the clearance between the first electrode 5 and the second electrode 7 in the second direction because of the grooves 11. Therefore, the dispersion of resistance of the chip thermistor 1 can be kept extremely small.

Figure 13:
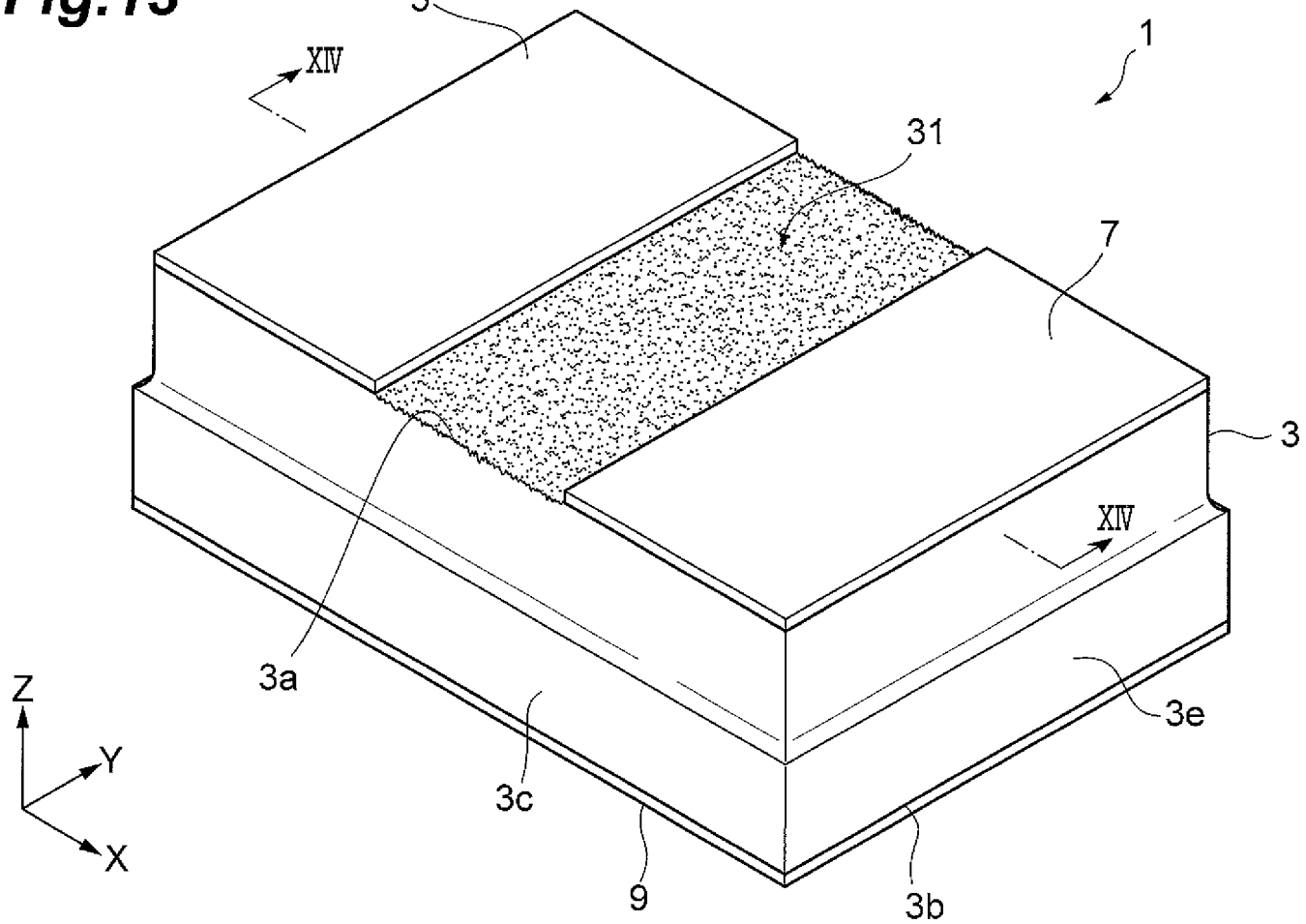
FIG. 13 is a perspective view showing a chip thermistor according to another modification example of the embodiment.
Figure 14:
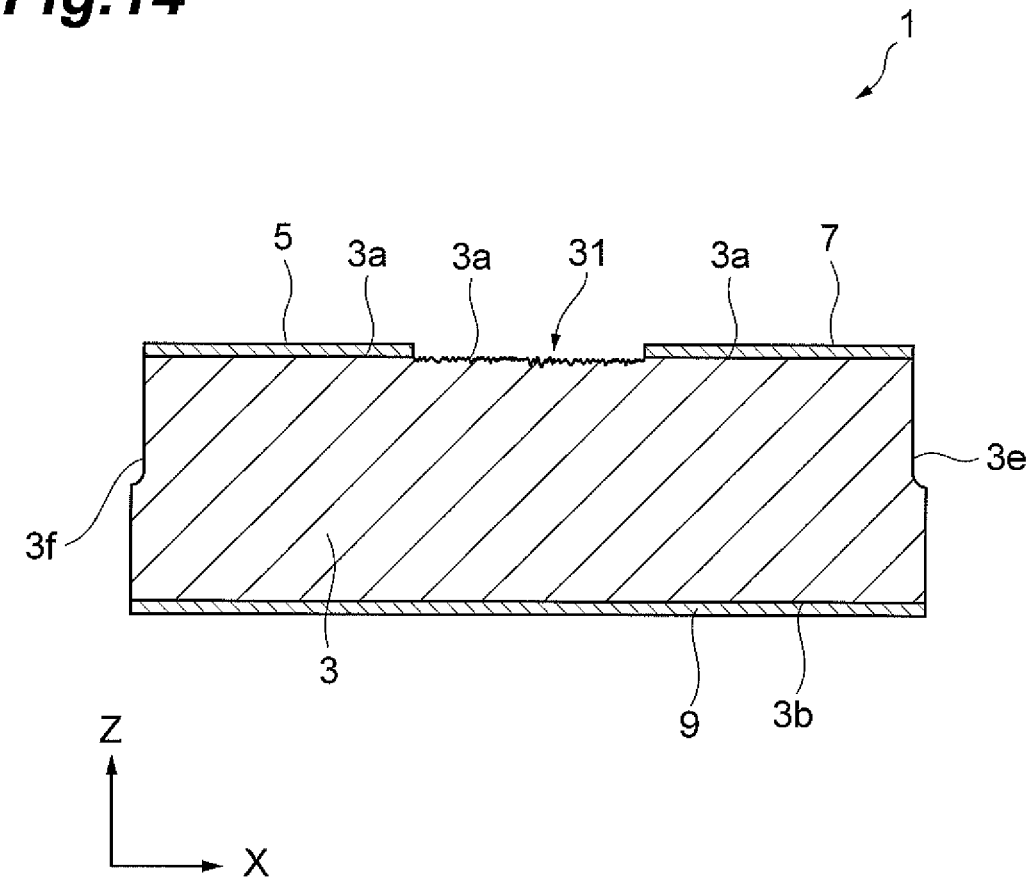
FIG. 14 is a drawing for explaining a cross-sectional configuration along the line XIV-XIV shown in FIG. 13.

Next, another modification example of the chip thermistor 1 according to the present embodiment will be described with reference to FIGS. 13 and 14. FIG. 13 is a perspective view showing the chip thermistor according to the modification example of the embodiment. FIG. 14 is a drawing for explaining a cross-sectional configuration along the line XIV-XIV shown in FIG. 13. In the present modification example, the region between the first electrode 5 and the second electrode 7 on the first principal face 3*a* has a roughened surface.

In the present modification example, the surface of the region between the first electrode 5 and the second electrode 7 on the first principal face 3*a* is roughened by a blasting process or by a laser irradiation process. This process forms irregular unevenness 31 in the region between the first electrode 5 and the second electrode 7 on the first principal face 3*a*. In the present modification example, the creepage distance between the first electrode 5 and the second electrode 7 in the second direction is also set to be larger than the clearance between the first electrode 5 and the second electrode 7 in the second direction. Therefore, the dispersion of resistance of the chip thermistor 1 is kept extremely small.

The above described the preferred embodiment of the present invention, and it should be noted that the present invention is by no means intended to be limited to the foregoing embodiment and can be modified in many ways without departing from the spirit and scope of the invention.

The composition of the thermistor element body 3 does not have to be limited to the aforementioned composition. The thermistor element body 3 may have, for example, a composition containing $BaTiO_3$ as a major component and containing a rare earth and a metal oxide of Pb, Sr, or the like as minor components.

The third electrode 9 may be covered by a material having an electrical insulation property (e.g., glass containing $SiO_2$ or insulating resin such as polyimide resin). In this case, the third electrode 9 is prevented from touching another component to cause a short circuit or the like. When the material with the electrical insulation property used herein is the glass containing $SiO_2$ or the insulating resin, it does not hinder the function as the heat radiation member.

The first and second electrodes 5, 7 are formed by the cutting of the electrode 23 in conjunction with the formation of grooves 11, 25, but the method of forming them is not limited to this method. The first and second electrodes 5, 7 may be formed by preliminarily patterning them on the first principal face 21*a* of the thermistor substrate 21.

The unevenness does not always have to be formed in the region between the first electrode 5 and the second electrode 7 on the first principal face 3*a*. When the unevenness is formed, the creepage distance between the first electrode 5 and the second electrode 7 in the second direction is set to be larger than the clearance between the first electrode 5 and the second electrode 7 in the second direction. Therefore, the unevenness is preferably formed in the foregoing region in that the dispersion of resistance of the chip thermistor 1 can be kept extremely small. The number and depth of grooves 11 are not limited to the aforementioned values.

The thermistor substrate 21 with the grooves 11, 25 formed therein is cut at the positions where the grooves 25 are formed, from the first principal face 21*a* side, but the cutting does not have to be limited to this method. For example, the thermistor substrate 21 with the grooves 11, 25 formed therein may be cut at the positions where the grooves 25 are formed, from the second principal face 21*b* side. Another available method is such that, after the formation of the grooves 11 in the thermistor substrate 21, the thermistor substrate 21 is cut from the first principal face 21*a* side or from the second principal face 21*b* side.

Figure 15:
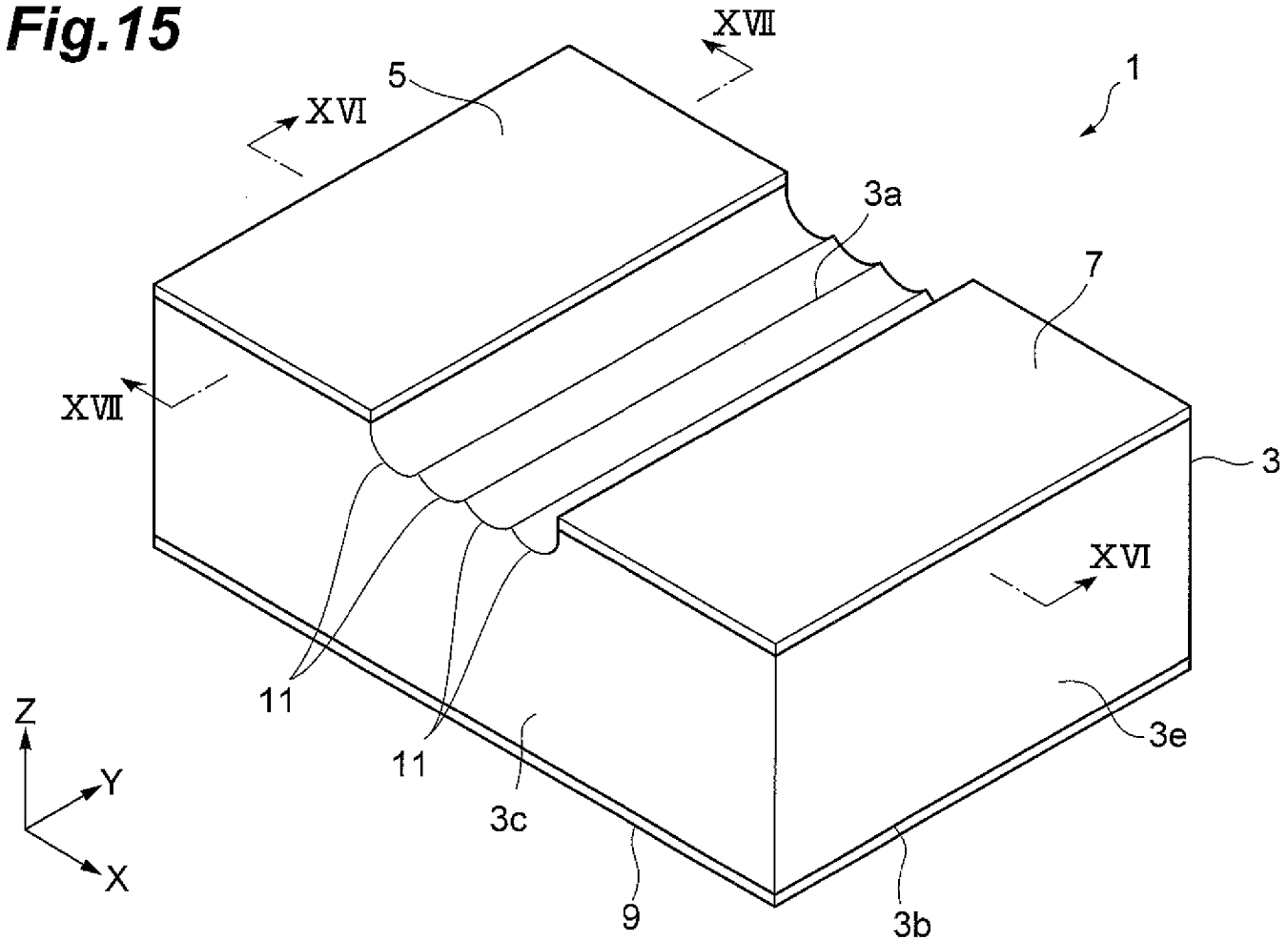
FIG. 15 is a perspective view showing a chip thermistor according to another modification example of the embodiment.
Figure 16:
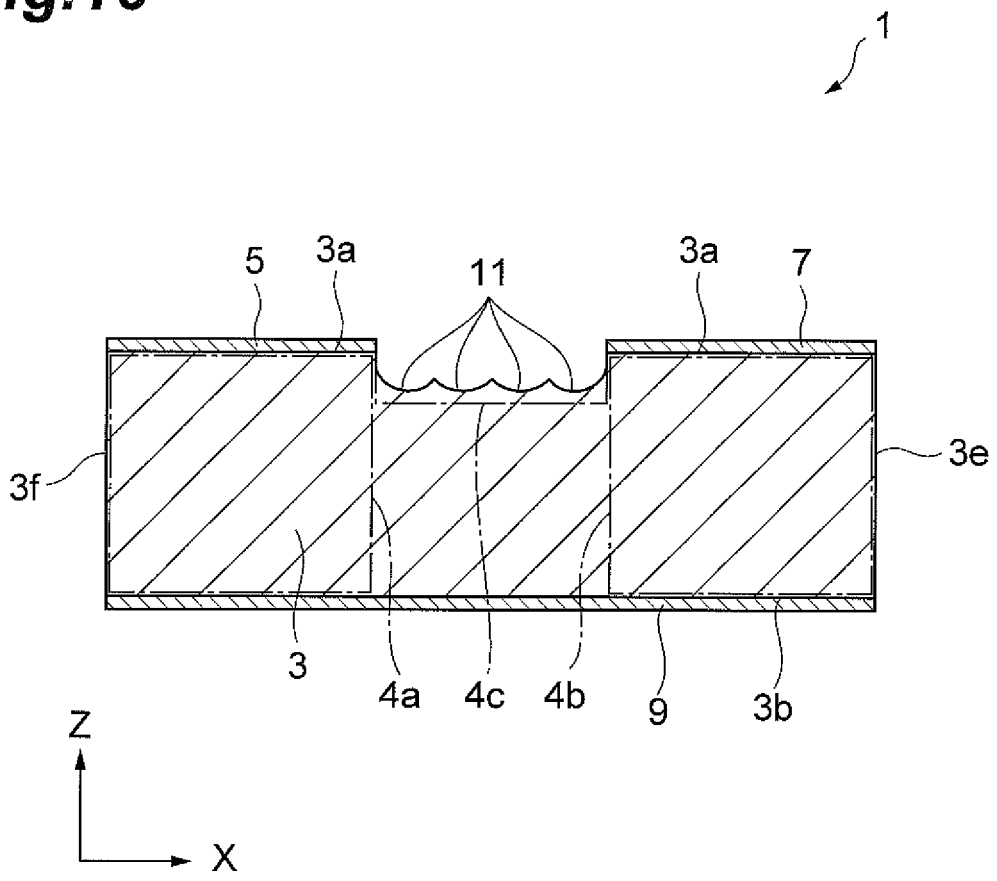
FIG. 16 is a drawing for explaining a cross-sectional configuration along the line XVI-XVI shown in FIG. 15.
Figure 17:
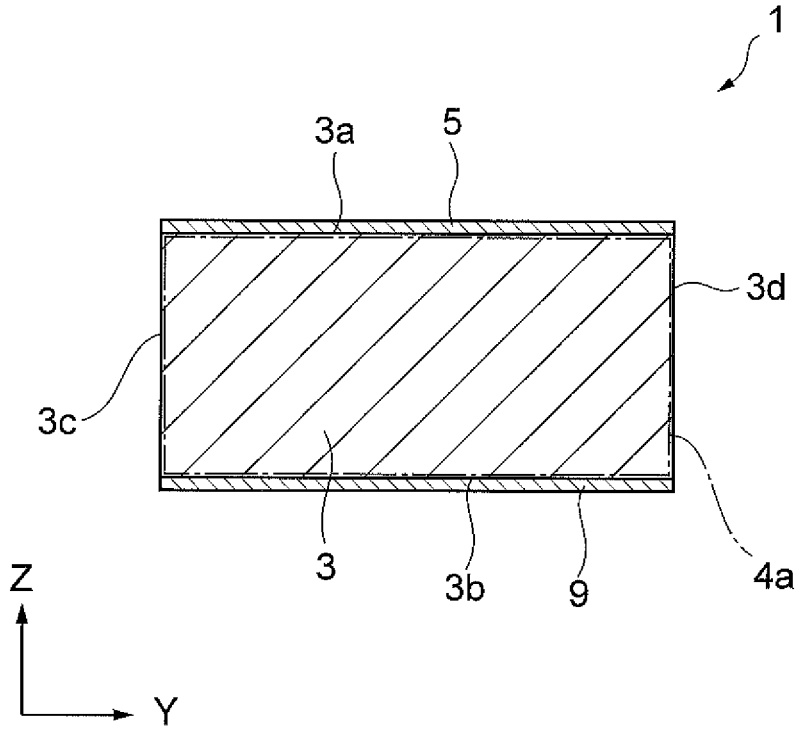
FIG. 17 is a drawing for explaining a cross-sectional configuration along the line XVII-XVII shown in FIG. 15.

In the present embodiment, when viewed from the first direction, the first principal face 3*a* is located inside the outer contour line of the second principal face 3*b* and the first and second electrodes 5, 7 are located inside the outer contour line of the third electrode 9, but the present invention is not limited to this example. For example, as shown in FIGS. 15 to 17, the outer contour line of the first principal face 3*a* may coincide with the outer contour line of the second principal face 3*b*, when viewed from the first direction. The outer contour lines of the first and second electrodes 5, 7 may be coincident in part with the outer contour line of the third electrode 9.

Figure 18:
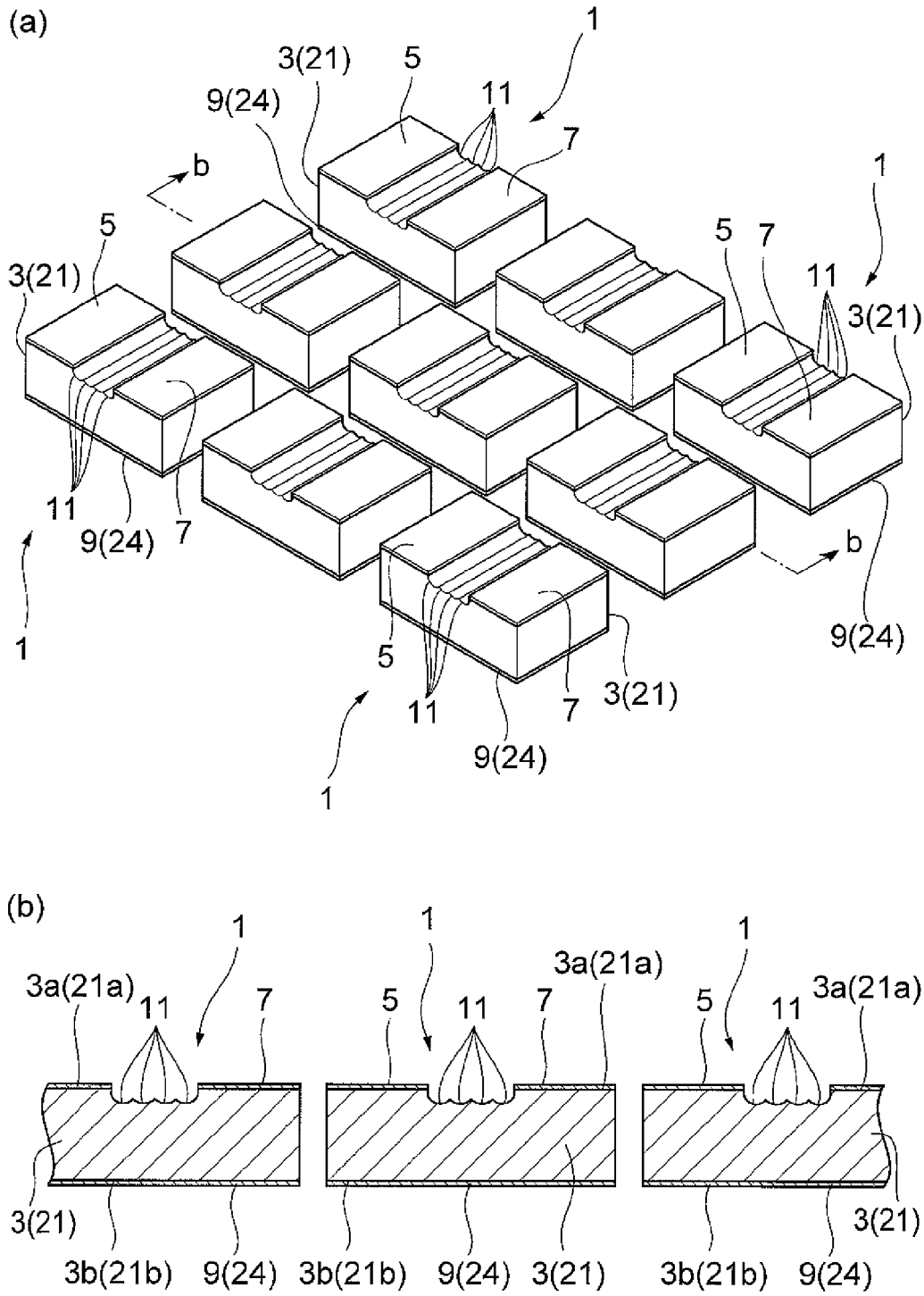
FIG. 18 is a drawing for explaining a manufacturing process of the chip thermistor according to the modification example of the embodiment.

The below will describe an example of a manufacturing process of the chip thermistor 1 shown in FIGS. 15 to 17, with reference to FIG. 18. The steps up to the formation of grooves 11 in the thermistor substrate 21 in the present manufacturing process are the same as in the manufacturing process of the aforementioned embodiment, and therefore the description of the preceding steps is omitted herein. In FIG. 18, (a) is a perspective view showing the cut thermistor substrate and (b) a drawing for explaining a cross-sectional configuration along the line b-b shown in (a).

The thermistor substrate 21 with the grooves 11 formed therein is cut, as shown in FIG. 18. This process results in obtaining the chip thermistors 1 shown in FIGS. 15 to 17. The cutting of the thermistor substrate 21 can be implemented with a dicing blade, as described above. At this time, the third electrodes 9 are defined as in the case of the manufacturing process of the aforementioned embodiment.

The above embodiments and modification examples described the examples of NTC thermistors as chip thermistors 1, but the present invention is not limited to them. The present invention may be applied to other chip thermistors such as PTC (Positive Temperature Coefficient) thermistors.

INDUSTRIAL APPLICABILITY

The present invention is applicable to the chip thermistors.

LIST OF REFERENCE SIGNS

1 . . . chip thermistor; 3 . . . thermistor element body; 3*a* . . . first principal face; 3*b* . . . second principal face; 5 . . . first electrode; 7 . . . second electrode; 9 . . . third electrode; 11 . . . grooves; 21 . . . thermistor substrate; 21*a* . . . first principal face; 21*b* . . . second principal face; 23, 24 . . . electrodes; 25 . . . grooves.

The invention claimed is:

1. A chip thermistor comprising:

a thermistor element body having first and second principal faces opposed to each other in a first direction;

first and second electrodes arranged as separated from each other in a second direction perpendicular to the first direction, on the first principal face of the thermistor element body; and a third electrode arranged so as to lap over the first and second electrodes, when viewed from the first direction, on the second principal face of the thermistor element body, wherein, when viewed from the first direction, the first principal face is located inside an outer contour line of the second principal face and the first and second electrodes are located inside an outer contour line of the third electrode.

2. The chip thermistor according to claim 1, wherein a creepage distance between the first electrode and the second electrode in the second direction is set to be larger than a clearance between the first electrode and the second electrode in the second direction.

3. The chip thermistor according to claim 2, wherein unevenness is formed in a region between the first electrode and the second electrode on the first principal face.

4. The chip thermistor according to claim 3, wherein a groove extending in a direction intersecting with the second direction is formed in the region between the first electrode and the second electrode on the first principal face.

* * * * *